US005720470A

United States Patent [19]

Johansson

[11] Patent Number: 5,720,470

[45] Date of Patent: Feb. 24, 1998

[54] BARRIER

[75] Inventor: Jerzy Kryszof Johansson, Hässleholm, Sweden

[73] Assignee: KJ Byggstal AB, Hassleholm, Sweden

[21] Appl. No.: 659,276

[22] Filed: Jun. 6, 1996

[30] Foreign Application Priority Data

Mar. 27, 1996 [SE] Sweden ..... 9601182

[51] Int. Cl.[6] ..... E01F 15/04

[52] U.S. Cl. ..... 256/13.1; 256/65; 404/6

[58] Field of Search ..... 256/65, 59, 13.1; 404/9, 6

[56] References Cited

U.S. PATENT DOCUMENTS

| | | | |
|---|---|---|---|
| 2,907,552 | 10/1959 | Crone | 256/13.1 |
| 3,276,750 | 10/1966 | DeRidder | 256/13.1 |
| 4,075,473 | 2/1978 | Winston | 256/13.1 |

FOREIGN PATENT DOCUMENTS

| | | | |
|---|---|---|---|
| 0 698 689 A1 | 2/1996 | European Pat. Off. . | |
| 1570598 | 5/1969 | France . | |
| 2698643 | 6/1994 | France | 256/13.1 |
| 315621 | 10/1969 | Sweden . | |
| 454522 | 5/1988 | Sweden . | |
| 17966 | of 1906 | United Kingdom | 403/268 |
| 1209191 | 10/1970 | United Kingdom . | |
| 1237198 | 6/1971 | United Kingdom | 256/13.1 |
| 1417109 | 12/1975 | United Kingdom | 256/13.1 |
| 2266910 | 11/1993 | United Kingdom | 256/13.1 |
| WO 88/00628 | 1/1988 | WIPO . | |

*Primary Examiner*—Anthony Knight
*Attorney, Agent, or Firm*—Luedeka Neely & Graham

[57] ABSTRACT

A barrier, especially intended for roads and bridges and comprising supports and impact-absorbing elements which extend between the supports and are connected to the supports. The impact-absorbing elements consist of tubes, rods or bars with mountings which are rigidly attached to the side of the tubes, rods or bars facing the supports and which leave the opposite side of the impact-absorbing elements free. The mountings have through holes for mounting members by means of which the mountings and the impact-absorbing elements are attached to the supports.

5 Claims, 7 Drawing Sheets

X
VII
VII
VIII
VIII
IX
IX
21
21'
21'
10
25
25
32
33
34
35
36
37
38

BARRIER

BACKGROUND OF THE INVENTION

The present invention relates to a barrier which is intended especially for roads and bridges.

Barriers of the types used for roads and bridges should be highly crash-resistant. Therefore standards for such barriers have been set by the road administrations in different countries. Most standards prescribe that the barrier should have elements absorbing the impacts at the same level as the hubcaps, i.e. a longitudinal beam positioned on the normal level of the hubcaps of the vehicles. Since automobiles and trucks have different wheel diameters, there elements must have a considerable vertical extent. The most common construction therefore is an impact-absorbing corrugated metal sheet of European standard. This corrugated metal sheet usually has two longitudinal ridges and an intermediate groove. The heads of the mounting bolts are arranged in this groove so as not to immediately touch vehicles sliding along the barrier. This type of barriers functions excellently as impact-absorbing elements but are unfavourable since they block the view. This is a particularly great disadvantage of barriers especially in urban and expressway environment since vehicles approaching a crossing adjacent the end of the barrier are in many cases difficult to see. Also for aesthetical reasons, a clearer view would be preferred, above all in areas much frequented by tourists. Therefore there is a need of dividing this impact-absorbing sectional metal sheet into individual impact-absorbing rods or tubes. Changing to such impact-absorbing elements, however, causes an additional problem since the road administrations in different countries require that the surface of the barrier facing the pavement be smooth and have no extensible mounting elements.

One object of the invention therefore is to eliminate this problem and provide a barrier which enables a clearer view but yet satisfies the requirements of, inter alia, strength that are placed by the road administrations.

This and other objects are achieved by means of a barrier in accordance with the present invention. The subclaims define particularly preferred embodiments of the invention.

SUMMARY OF THE INVENTION

Summing up, the invention lies in a barrier especially intended for roads and bridges and comprising posts and impact-absorbing elements extending between the supports and connected thereto. The impact-absorbing elements consist of tubes, rods or bars with mountings which are rigidly attached to the side of the tubes, rods or bars facing the supports and which leave the opposite side of the impact-absorbing elements free. The mountings have through holes for mounting members, by means of which the mountings and the impact-absorbing elements are attached to the supports.

BRIEF DESCRIPTION OF THE DRAWINGS

The invention will now be described in more detail with reference to the accompanying drawings which illustrate five embodiments of a barrier which is designed according to the invention and is intended for use as a bridge parapet. In the drawings.

DESCRIPTION OF THE PREFERRED EMBODIMENTS

Figure 2:
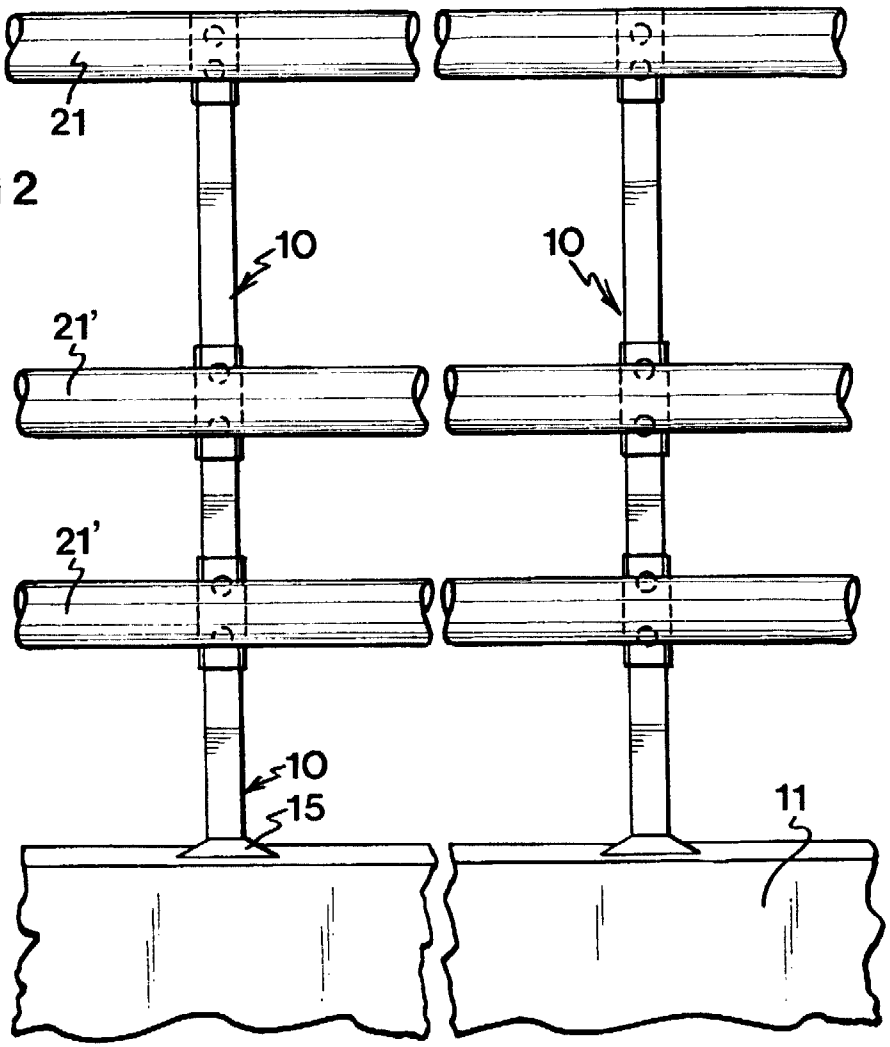
FIG. 2 shows the same barrier as seen from the right in respect of FIG. 1.
Figure 1:
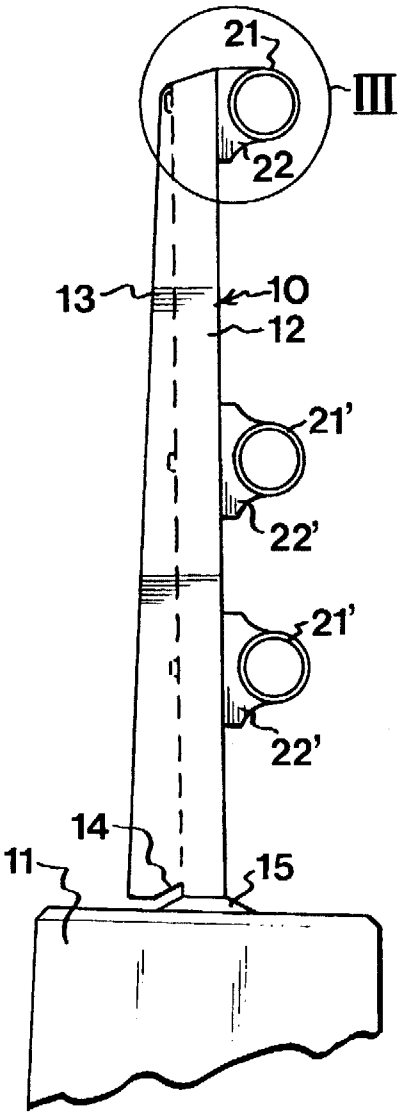
FIG. 1 is a sectional view of a first barrier shown by way of example.

The embodiment of an inventive barrier as illustrated in FIGS. 1–11 comprises supports 10 attached in foundations or directly in a bridge structure 11, if a bridge parapet is involved. The supports comprise a preferably solid steel bar 12 which extends into the foundation or bridge structure and the rear side of which (to the left in FIG. 1) has a U-section 13 attached by welding. The flanges of the U-section are beveled, such that the web of the U-section is inclined outwardly-downwardly, as is evident from FIGS. 1 and 3. There are two purposes of this beveling, viz. to increase the flexural rigidity of the support and, thus, its ability to absorb forces, and to give the support an aesthetically more attractive appearance. In order to facilitate the casting of the support into the foundation or bridge structure 11, the flanges of the U-section 13 can at the bottom terminate in a beveled edge 14, thereby leaving room for the casting of a fillet or haunch strip 15 against the steel bar.

The steel bar has through holes 16 for mounting bolts 17. Just in front of these holes there is an aperture 18 in the web 19 of the U-section to permit insertion of the mounting bolt and a spanner into the U-section. A snap-on cap 20 is used to close the aperture 18. The components 16–20 are arranged in pairs on the same level as the impact-absorbing elements of the barrier.

According to the invention, the impact-absorbing elements are designed as longitudinal tubes 21 with mountings 22 which are welded to the side of the tube facing the support 10. A great advantage is that the tubes can be ordinary standard tubes. This involves a considerable cost saving compared with a rolled impact-absorbing sheet-metal section, although the mountings 22 must be welded on. The mountings are designed as U-sections, whose flanges are formed with recesses for the tube 21, such that the mounting encloses merely a sector of the rear side of the tube and the front of the tube is completely free. In the web of the mountings 22, there are elongate holes or slots 24 just in front of the through holes 16. By these holes 24 being slot-shaped, a certain tolerance as regards the mutual distance between neighbouring supports 10 will be achieved. The flanges of the mountings 22 are of such a height that a nut and a washer can be inserted when mounting the mounting bolt 17. The web of the mountings is of such a width that there is room for a wrench or the like when tightening the screw joint.

Figure 5:
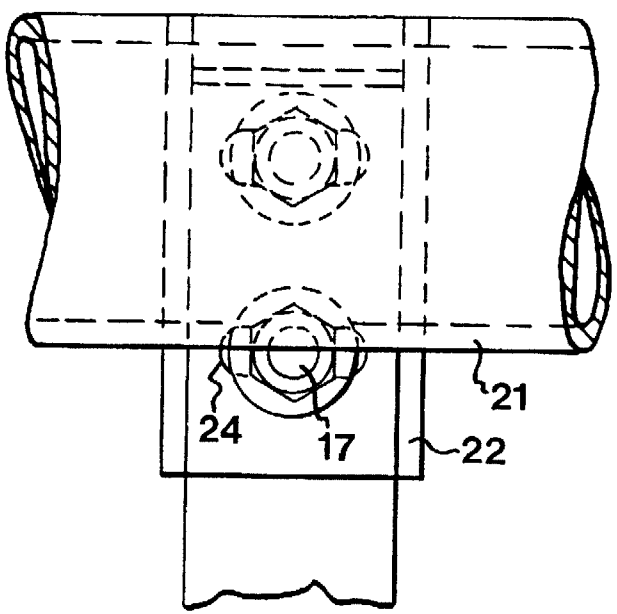
FIG. 5 is a view from the right in respect of FIG. 3.
Figure 3:
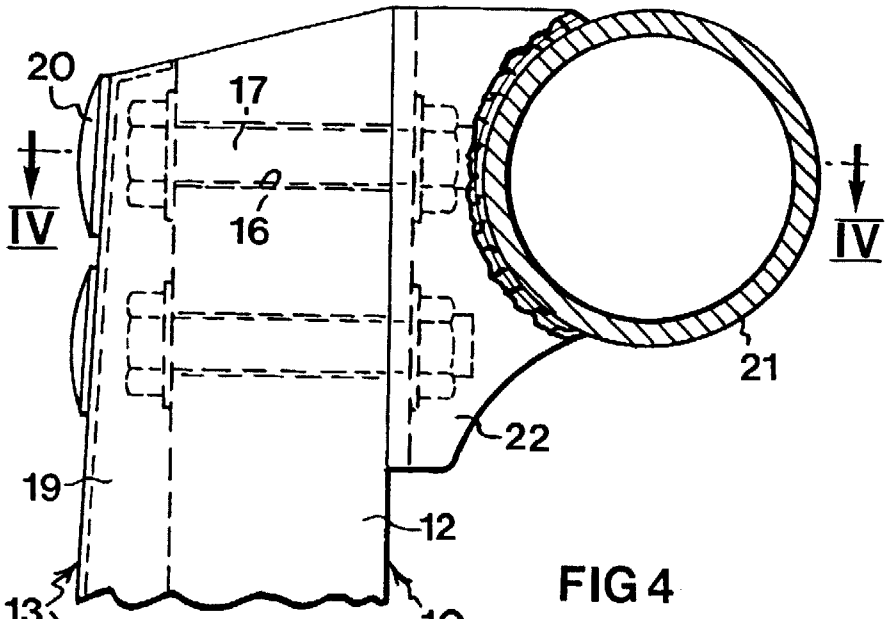
FIG. 3 shows the portion indicated by III in FIG. 1 on a larger scale.
Figure 4:
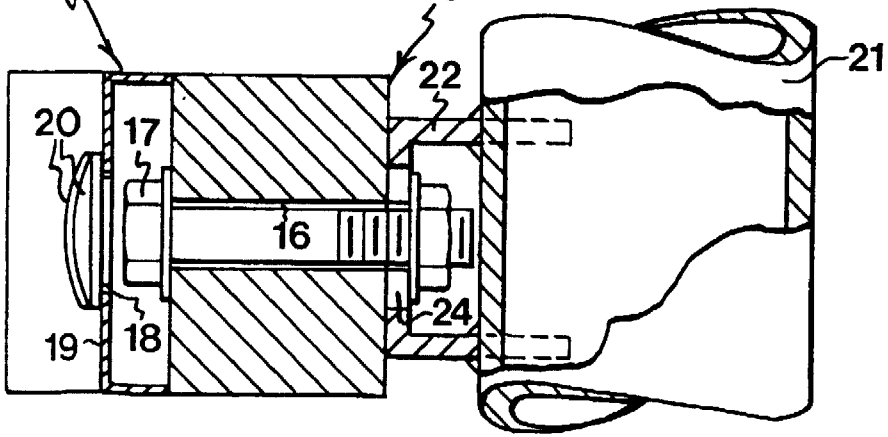
FIG. 4 is a sectional view along line IV—IV in FIG. 3.

FIGS. 3–5 show the constructional details of the upper impact-absorbing element of the barrier. The impact-absorbing elements 21' which are closer to ground level and intended to serve as elements absorbing the impacts at the level of hubcaps, are designed correspondingly, although their mountings 22' are slightly differently designed by their upper and lower ends being reversed. The distance between the tubes 21' absorbing the impacts at the level of hubcaps preferably corresponds to the distance between the ridges of the presently used corrugated sections absorbing such impacts and designed according to European standard. A great advantage of the present invention is that it increases the view through the barrier although, by its design with posteriorly situated, welded-on mountings, it satisfies the requirements for crash resistance and smoothness, i.e. freedom from parts projecting on the inside of the barrier.

FIGS. 6–11 illustrate how the barrier can be joined. The joints can also be used as expansion joints, if desired. On both sides of the barrier portion, where the joints are to be positioned, there are force-absorbing struts 25. The struts 25 are formed as flat rolled steel bars. At their lower end, they are either welded directly to the rear side of the supports 10 or screwed to mounting projections which in turn are welded to the supports (not shown). The struts 25 are at their upper end attached to a mounting 26 by means of bolts 27. The mounting is in turn welded to the support 10 on the one hand along an arcuate portion 28 of the rear side thereof and, on the other hand, along a straight portion 29 of the underside thereof by a triangular metal sheet 30 being arranged obliquely downwards from a position close to the center of the tube. The mounting 26 also comprises an obliquely downwardly directed fastening portion 31 having holes for the bolts 27.

Figures 6, 7, 8, 9:
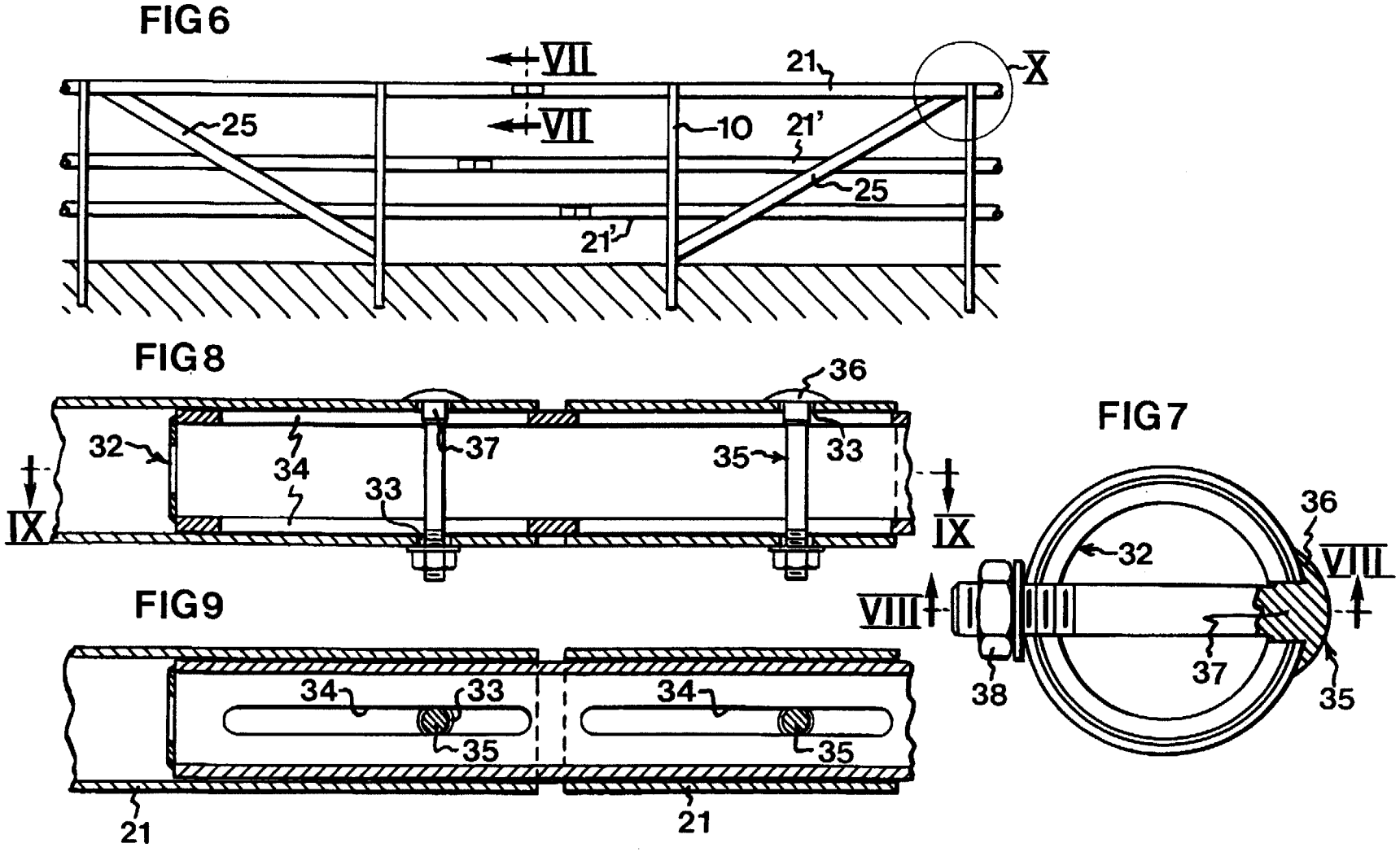
FIG. 6 shows a portion with joints in the barrier, seen from the left in respect of FIG. 1.
FIG. 7 is a sectional view along line VII—VII in FIG. 6.
FIG. 8 is a sectional view along line VIII—VIII in FIG. 7.
FIG. 9 is a sectional view along line IX—IX in FIG. 8.
Figure 11:
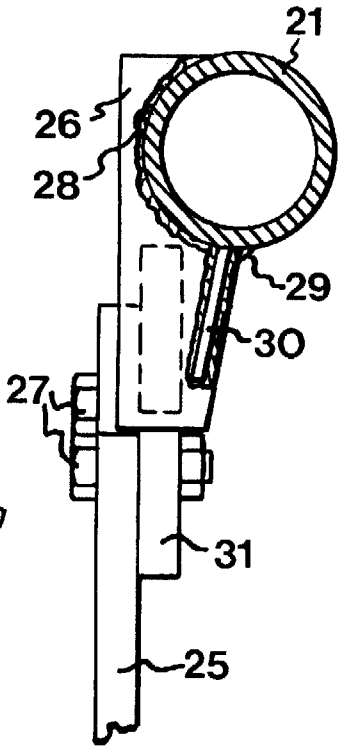
FIG. 11 is a sectional view along line XI—XI in FIG. 10.
Figure 10:
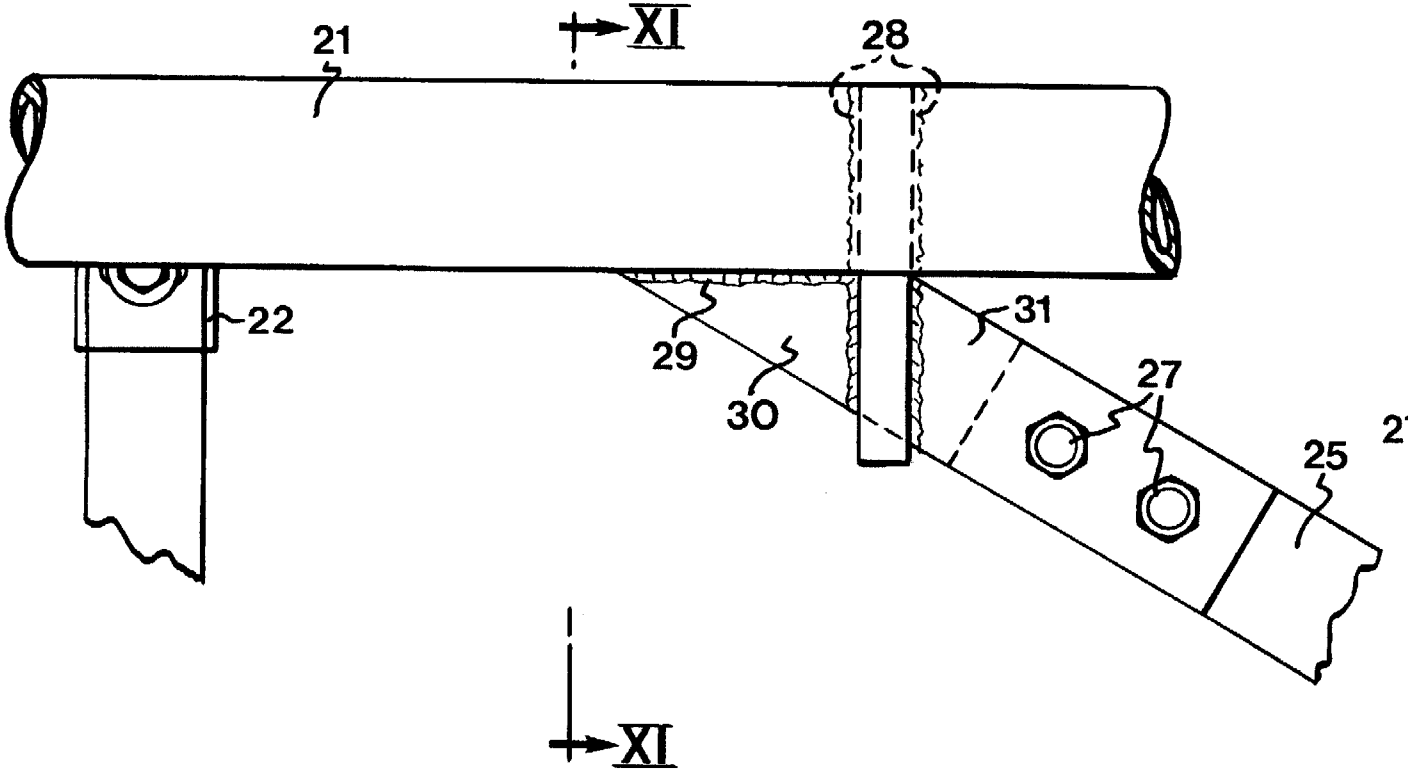
FIG. 10 shows the portion indicated by X in FIG. 6, on a larger scale, although seen from the opposite side of the barrier.

The joints in the three tubes 21, 21' are relatively offset in the longitudinal direction of the barrier, as shown in FIG. 6. To obtain sufficient flexural rigidity in the joint area, a tubular joint mandrel 32 is inserted in the ends of the two tubes meeting at the joint. A number of through holes 33 are formed in the tubes. The joint mandrel 32 has a corresponding number of elongate holes 34 or axial slots, thereby making it possible to pass king pins 35 through the holes 33 and the joint mandrel 32. The lower side of the heads 36 of the king pins has been upset to the same radius as the exterior of the tube 21. The square portion 37 of the king pins is inserted with a slide fit in the slots 34 to make it possible to clamp the king pins by means of the nuts 38.

Figure 12:
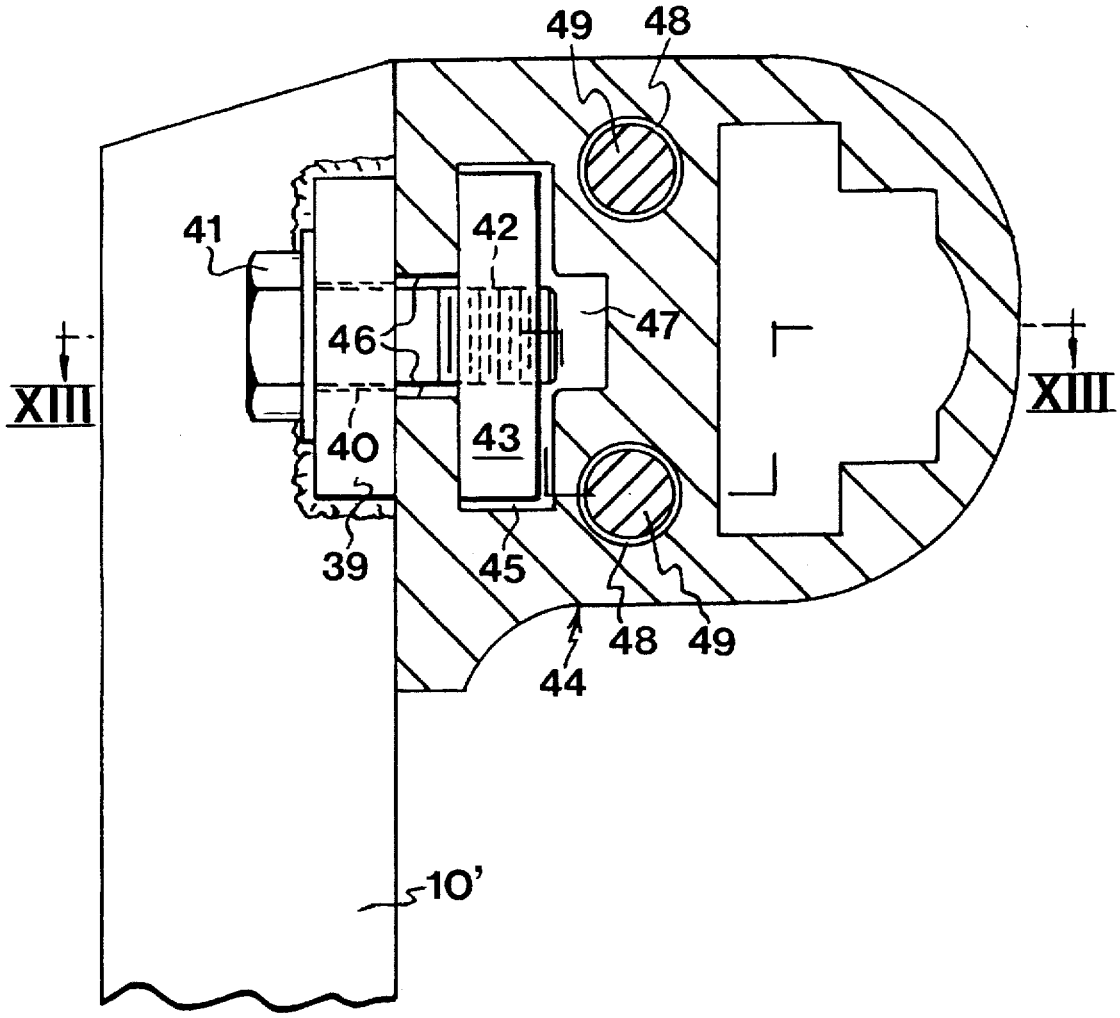
FIG. 12 is a cross-sectional view, corresponding to FIG. 3, of a further embodiment of a barrier according to the invention.
Figure 13:
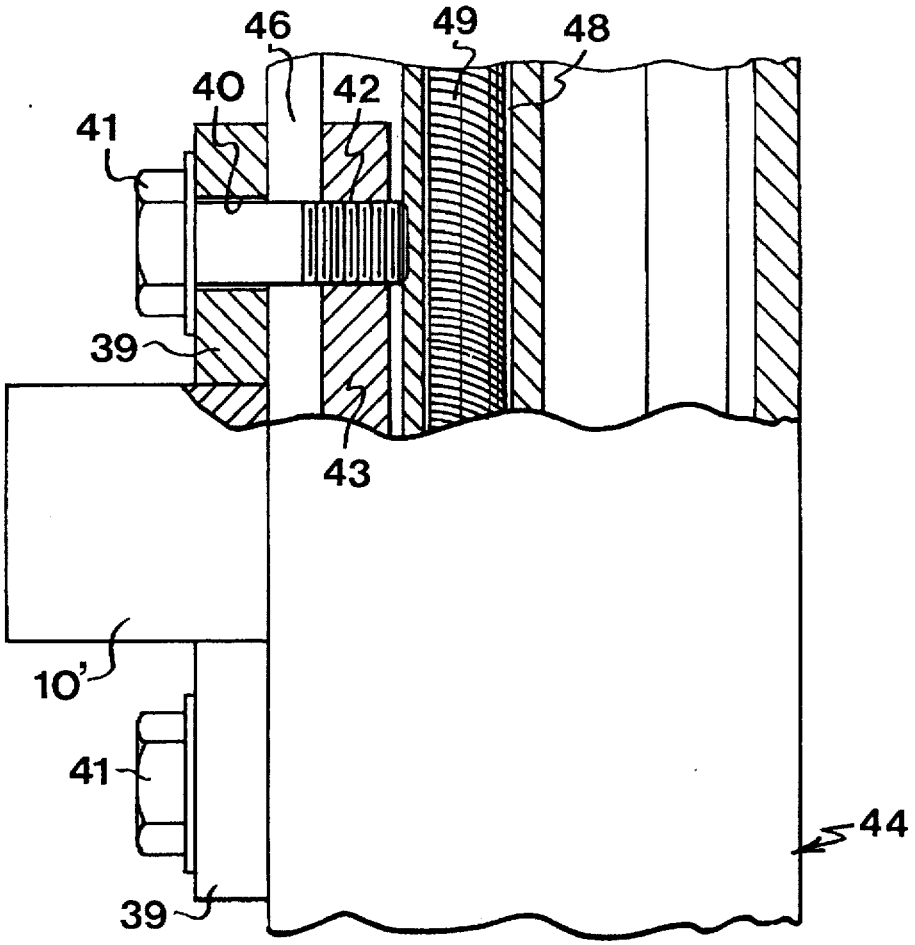
FIG. 13 is a sectional view along line XIII—XIII in FIG. 12.
Figure 14:
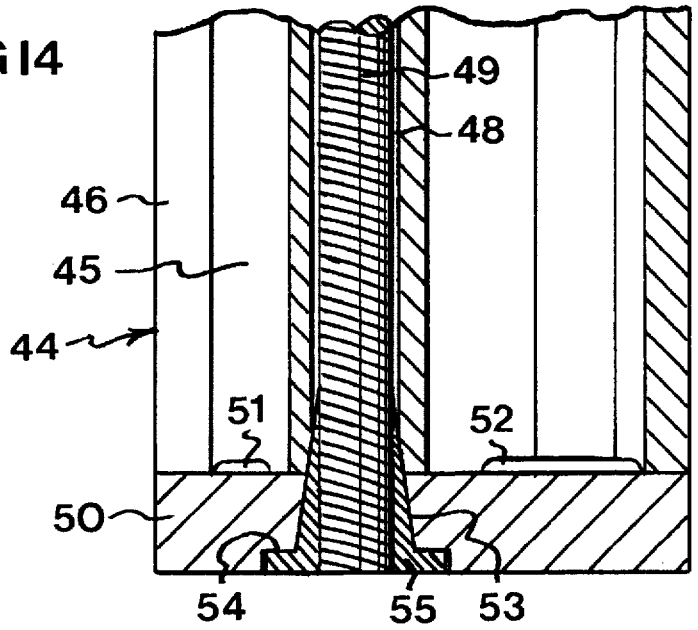
FIG. 14 is a sectional view of the end of an impact-absorbing element and a terminating wire clamp.

The second embodiment of the invention as illustrated in FIGS. 12–14 comprises supports 10' of square bar material of standard type (55×55 mm). In the positions where impact-absorbing bars are to be attached, lugs 39 have been attached by welding so as to project in both directions along the support side on which impact-absorbing bars are to be arranged. The lugs 39 have through holes 40 for passing through clamping bolts 41. The clamping bolts run freely through the holes 40 and are fastened in threaded holes 42 in a clamping plate 43.

The impact-absorbing elements 44 are bar-shaped or tubular and can advantageously be designed as extruded aluminum profiled bars. On the side of the impact-absorbing elements that should abut against the supports 10' and the lugs 39, the impact-absorbing elements 44 have an undercut groove 45 for receiving the flat clamping bar or nut 43. The opposite mouth edges 46 of the undercut groove therefore project between on the one hand the clamping bar or nut 43 and, on the other hand, the lugs 39 and the support 10'. In the undercut groove, there is a longitudinal portion 47 for receiving the ends of the clamping bolts 41.

The profiled bar 44 has two longitudinal holes 48 through which steel wires 49 extend. After mounting, the steel wires are pretensioned in the same way as the impact-absorbing structures formed of wires that are now frequently used along expressways.

To permit such pretensioning, the arrangement illustrated in FIG. 14 can be used. At the free end of the profiled bar 44 at the end of the barrier, use is made of a steel plate 50 which can have guiding projections 51, 52 for aligning the steel plate relative to the profiled bar. The steel plate has a conical through hole 53 with a circumferential shoulder 54. A wire clamp 55 is clamped to the end of the steel wire 49 in prior-art manner. The wire clamp fits into the space formed of the hole 53 and the shoulder 54. At the other end of the bridge parapet, use is made of an identical arrangement. Before the wires 49 are pretensioned, a corresponding wire clamp 55 is slipped onto the wires. After the wires being tensioned slightly more than required in the bridge parapet, the wire clamps 55 are clamped to the wires, whereupon the tensile force to which the wires are subjected is released. The wire clamps 55 will then be pulled into the holes 53 and come into abutment against the shoulders 54. Finally, the wires are cut off outside the wire clamps 55.

The side of the profiled bar 44 facing away from the supports 10' is rounded and hollow. In this case, it is for economical reasons convenient to have all three bars designed in the same manner, but the lower bars absorbing the impacts at the level of the hubcaps can be designed in a reversed manner round the T-groove 45.

To permit joining of the profiled metal bar 44 and provide a saving of material, there is also a longitudinal hole 56. In this hole and also in the T-groove 45, complementarily designed extension rods are inserted. The extension rods will absorb the bending moment acting on the impact-absorbing element in the joint area.

Figure 15:
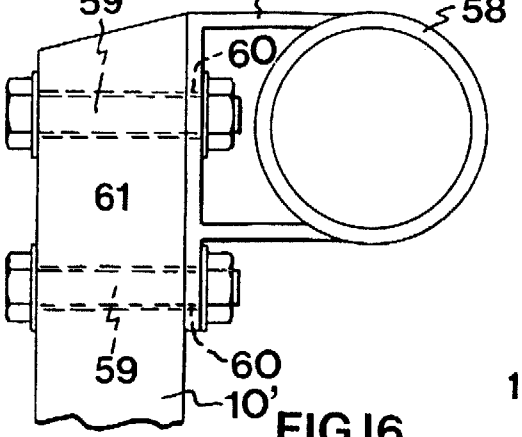
FIG. 15 shows a third embodiment of an inventive barrier.

In the embodiment shown in FIG. 15, the mounting 57 consists of an F-sectional element, whose cross-bars are welded to the rod or tube 58. Mounting bolts 59 are passed through holes 60 in the F-sectional element and through mounting holes 61 in the supports 10'.

Figure 17:
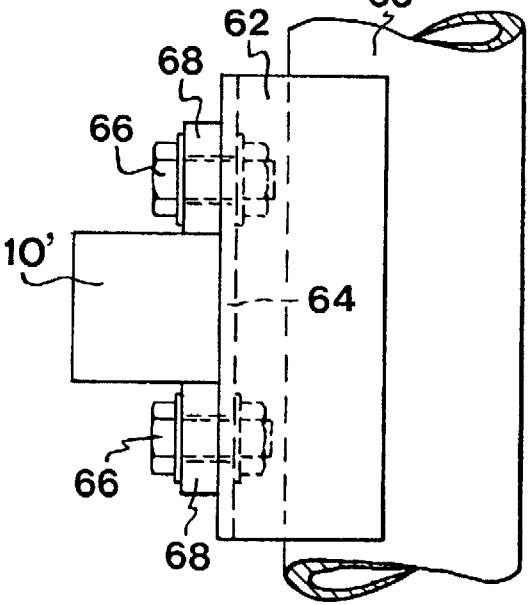
FIG. 17 is a sectional view along line XVII—XVII in FIG. 16.
Figure 16:
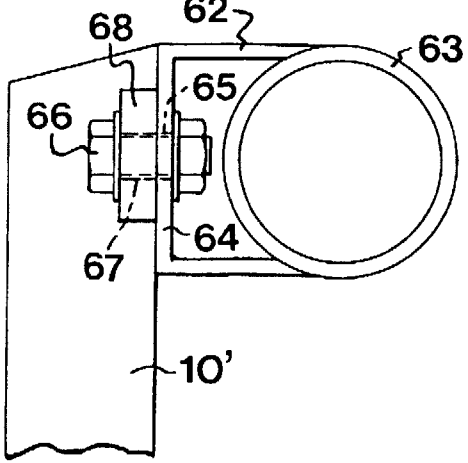
FIG. 16 shows a fourth embodiment of an inventive barrier.

In the embodiment according to FIGS. 16 and 17, a U-sectional element 62 is used as a mounting. The flanges of the U-sectional element are welded to the tube 63. The web 64 of the U-sectional element has through holes 65 for mounting bolts 66. These have also been passed through holes 67 in lugs 68 which are welded to the support 10' in the same manner as in the embodiment according to FIGS. 12–14. The holes 65 in the web 64 are elongate holes or slots, thereby achieving the necessary tolerances for mounting purposes.

Figure 18:
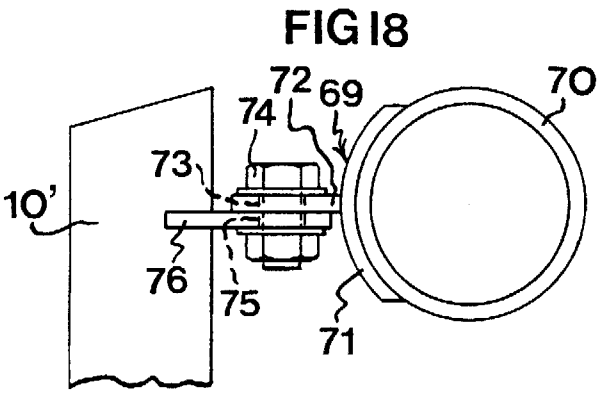
FIG. 18 illustrates a fifth embodiment of an inventive barrier.
Figure 19:
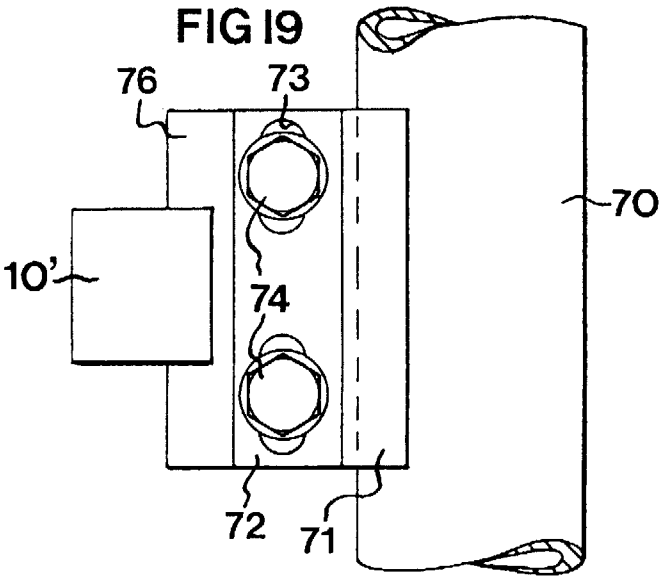
FIG. 19 is a vertical view of the embodiment shown in FIG. 18.

The embodiment according to FIGS. 18 and 19 also comprises a mounting 69 which is welded to the rear side of a tube 70 intended for use as impact-absorbing element. The mounting comprises a bent plate 71 to which a piece 72 of flat steel is welded. The flat steel piece 72 has through holes 73 for mounting bolts 74. The mounting bolts are passed through holes 75 in a further piece of flat steel 76. This is in turn welded to the post 10'.

The drawings illustrate bridge parapets, the two lower impact-absorbing elements being adapted to serve as elements absorbing the impacts at the level of the hubcaps and the upper element being adapted to serve as handrail. If the barrier is to be used as central barrier on expressways or the like, use is suitably made of two impact-absorbing elements only, the upper being designed as shown in FIG. 12 and at the top in FIG. 1, and the lower being designed as shown in FIG. 12 and at the bottom in FIG. 1.

As is evident from what has been said above, the invention has solved many of the problems of today's constructions for bridge parapets and crash barriers and has provided a barrier which despite the improved view through the barrier complies with all the requirements placed on barriers by the road administrations in different countries. Moreover, the invention has offered the possibility of changing to an aluminum material for the impact-absorbing elements by reinforcing them by the insertion of one or more pretensioned metal wires.

What I claim and desire to secure by Letters Patent is:

1. A barrier, comprising:

a plurality of supports connectable to a foundation adjacent a roadway, each of said supports having a first exterior side opposite a second exterior side and defining a plurality of apertures extending between the first and second exterior sides thereof;

a plurality of elongate impact-absorbing members, each of said impact-absorbing members having a first exterior side opposite a second exterior side, said second exterior side having a substantially smooth uniform surface for being impacted by vehicles accidentally departing from the roadway, with the first exterior side of each member being securely positionable adjacent to and spaced apart from the first exterior side of each of said supports in a spaced apart relationship to the other of said impact absorbing members; and a plurality of mounts for positioning said impact-absorbing members adjacent said supports such that said second exterior side of each of the impact absorbing members is positionable adjacent to and above the roadway, each of said mounts comprising:

a mounting member having a base and a pair of legs having free ends extending outwardly from the base at opposite ends thereof, said base being configured to abut the first exterior side of one of the supports and defining at least one aperture therethrough, and the free ends of the legs configured to matingly receive only the first exterior side of one of the impact-absorbing members, a fastener positionable to extend through the aperture of the base and one of the apertures of the supports for securely fastening the base of the mounting member to the support, said legs of the mounting member extending from the base a distance sufficient to provide access to the fastener for installation thereof, and a weld extending along the juncture between each of the legs and the first exterior side of each of the impact-absorbing member where the impact-receiving members are matingly received by the legs for permanently securing the legs to the impact-absorbing member.

2. The barrier of claim 1, wherein said impact-absorbing members comprise tubes.

3. The barrier of claim 1, wherein the aperture through the base is slot-shaped and elongate in the longitudinal direction of the impact-absorbing elements.

4. A barrier for roadways, said barrier comprising:

a plurality of supports connectable to a foundation adjacent the roadway, each of said supports having a first side opposite a second side and defining a plurality of apertures extending between the first and second sides thereof;

a plurality of elongate impact-absorbing members, each of said impact-absorbing members having a first side opposite a second side, with the first side of each member being securely positionable adjacent to and spaced apart from the first side of each of said supports in a spaced apart relationship to the other of said impact absorbing members; and a plurality of mounts for positioning said impact-absorbing members adjacent said supports, each of said mounts comprising:

a first mounting member having a first end opposite a second end, said first end configured to abut the first side of one of the impact-absorbing members, a second mounting member having a first end rigidly connected to the first side of one of said supports and a second end extending outwardly therefrom in a direction substantially perpendicular to the length of the support, fastening means for fastening the second end of the second mounting member to the second end of the first mounting member, and a weld extending along the juncture between the first end of the first mounting member and the first side of the impact-absorbing member for rigidly securing the first mounting member to the impact-absorbing member.

5. The barrier of claim 4, wherein the first mounting member and the second member each define apertures, therethrough and are positioned in alignment with one another and the fastening means comprises a bolt extending through the apertures.

* * * * *

UNITED STATES PATENT AND TRADEMARK OFFICE

CERTIFICATE OF CORRECTION

PATENT NO. : 5,720,470

DATED : February 24, 1998

INVENTOR(S) : Jerzy Kryszof Johansson

It is certified that error appears in the above-indentified patent and that said Letters Patent is hereby corrected as shown below:

Column 1, line 21, change "This" to -- These --

Column 1, line 21, change "functions" to -- function --

Column 4, line 8, after "between" insert -- comma (,) -- and after "hand" insert -- comma (,) --

Column 4, line 28, change "being" to -- have been --

Column 4, line 41, change "round" to -- around --

Column 4, line 51, change "through holes" to -- through-holes --

Column 4, line 56, change "through holes" to -- through-holes --

UNITED STATES PATENT AND TRADEMARK OFFICE

CERTIFICATE OF CORRECTION

PATENT NO. : 5,720,470

DATED : February 24, 1998

INVENTOR(S) : Jerzy Kryszof Johansson

It is certified that error appears in the above-indentified patent and that said Letters Patent is hereby corrected as shown below:

Column 4, line 67, change "through holes" to
-- through-holes --

Column 5, line 19, change "changing to an" to
-- using --

Signed and Sealed this

Second Day of June, 1998

*Attest:*

*Attesting Officer*

Bruce Lehman

BRUCE LEHMAN

*Commissioner of Patents and Trademarks*